United States Patent [19]

Sasaki

[11] Patent Number: 4,579,408

[45] Date of Patent: Apr. 1, 1986

[54] ELECTRICAL CONNECTOR STRUCTURE WITH RELEASE AND LOCKING MECHANISM

[75] Inventor: Masao Sasaki, Takasaki, Japan

[73] Assignee: OKI Densen Kabushiki Kaisha, Japan

[21] Appl. No.: 596,734

[22] Filed: Apr. 4, 1984

[30] Foreign Application Priority Data

Apr. 11, 1983 [JP] Japan ..... 58-52731[U]
Aug. 15, 1983 [JP] Japan ..... 58-125553[U]

[51] Int. Cl.[4] ..... H01R 13/627; H01R 13/635

[52] U.S. Cl. ..... 339/45 M; 339/66 M; 339/91 R

[58] Field of Search ..... 339/45 R, 45 M, 65, 339/66 R, 66 M, 91 R

[56] References Cited

U.S. PATENT DOCUMENTS 4,241,966 12/1980 Gomez ..... 339/45 M

FOREIGN PATENT DOCUMENTS 55-24236 6/1980 Japan .
56-25755 6/1981 Japan .
56-81485 7/1981 Japan .
57-17755 4/1982 Japan .
57-86281 5/1982 Japan .

*Primary Examiner*—Neil Abrams
*Attorney, Agent, or Firm*—Lane and Aitken

[57] ABSTRACT

In an electrical connector locked and released by means of snap members, a supporting axle of the snap member is located between a sector-shaped bottom surface of the snap member and center of curvature of the sector so as to allow pivotal axis of the snap member to travel along elongated holes provided in the side walls as the snap member is pivoted and/or knurled edge and rib are provided at the top end of the snap member for guiding the female connector toward the male connector pins so as to align the pin holes of the female connector with the male connector pins.

10 Claims, 15 Drawing Figures

ELECTRICAL CONNECTOR STRUCTURE WITH RELEASE AND LOCKING MECHANISM

BACKGROUND OF THE INVENTION

The present invention relates generally to an electrical connector structure wherein male and female connectors are coupled to connect the male and female pins thereof and more specifically relates to an electrical connector structure wherein mutual release and locking of the male and female connectors are facilitated by the lever action of a snap member associated with the male connector.

The same Applicant has filed Japanese Utility Model Registration Ser. No. 58-51425 filed on Apr. 8, 1983.

The disclosure of this Utility Model Registration No. 58-51425 is hereby incorporated by reference and will be described hereinbelow with reference to FIGS. 1 through 6.

In these drawings, symbol A denotes a male connector and B denotes a female connector. Numeral 2 denotes a flat flexible cable. The male connector A is provided with a plurality of male connector pins 1 extending longitudinally through a frame 16 which is transversely elongated. On the other hand, the female connector B connected to a flat flexible cable is provided with a plurality of female connector pin holes (not shown) to be connected individually with the male connector pins 1. The male connector A is formed with side walls 17, 18 disposed parallel to each other longitudinally on the front and rear sides of the frame 16 at each end thereof with a clearance therebetween for guiding the female connector B into proper alignment with the male connector pins 1 to ensure accurate insertion of the male connector pins 1 into the corresponding female pin holes.

A snap member 6 is interposed between the left and right side walls 17, 18 as denoted by **6*l* and 6*r*. The bottom of each snap member 6 is provided with a gear-tooth-shaped groove 21. A hole 5 extending between the side walls 17, 18 is located above the groove 21. An axle 4*l*, 4*r* is fitted into each of the corresponding holes 5 and also guidably fitted into an oblique, elongated groove 24*l*, 24*r* which is parallel to a rolling surface 23 at the base of the male connector A. As shown in FIG. 4, when the male and female connectors A and B are fitted to each other and locked by means of each engagement pawl 7*l*, 7*r*, the snap member 6 is in contact with the rolling surface 23 at a point C near an upwardly projecting finger 8 of the snap member 6**.

It should be noted that the axle **4*l*, 4*r*** is located at a center of radius of curvature formed at the bottom surface of the snap member.

As the snap member 6 is pivoted on the axle **4*l*, 4*r* outward as seen in FIG. 5**, the contact point is moved from the point C to a point D.

When the snap member 6 is pivoted to its outward limit of travel, the contact point is further moved from the point C to a point E as shown in FIG. 6. As this movement is being carried out, the supporting axle **4*l*, 4*r* of each snap member 6 translates outward within the corresponding groove 24*l*, 24*r*. In order for each snap member to pivot smoothly without slipping, it is desirable that the groove 21 of each snap member 6 engage a gear-tooth-like projection on the rolling surface 23 of the frame 16. As shown in FIGS. 4 to 6, since the distance through which each snap member 6** pivots is short, one tooth is sufficient for this pivotal movement.

In this approach, the distance between the contact points C, D, E and the upwardly extending finger **8*l*, 8*r* increases as the distance through which the snap member 6*l*, 6*r* is pivoted increases. However, the distance therefrom to the top end 14*l*, 14*r* of each snap member 6*l*, 6*r* remains substantially unchanged. Therefore, at the beginning of pivotal movement in the opening direction of the snap members 6*l*, 6*r*, the leverage is so great that a relatively light pivotal force on the snap members 6*l*, 6*r* is needed to displace the female connector B out of engagement with the male connector A. The leverage decreases as the female connector pins are removed from the corresponding male connector pins 1 to a minimum at the limit of outward travel of each snap member 6. Therefore, the distance through which the female connector B is moved per unit of displacement of each snap member 6** increases. This is acceptable since when the male connector pins 1 are not engaging the corresponding female connector pins, only a light pivoting force is required in spite of the above-described decrease in leverage.

However, such an electrical connector has the disadvantage that the upwardly projecting fingers **8*l*, 8*r* can easily disengage from the bottom edge of the female connector B as appreciated from FIG. 6 when the corresponding snap member 6*l*, 6*r*** is fully pivoted to detach the female connector pin holes from the corresponding male connector pins.

SUMMARY OF THE INVENTION

With the above-described disadvantage in mind, it is an object of the present invention to provide an improved space-saving electrical connector structure which allows easier and securer separation of the female connector pin holes from the male connector pins without extra pivoting force on the pair of snap members and without slipping of an operator's finger touching the top end of one of the snap members when he pivots the snap member through his finger and which can guide the female connector into the male connector with a single operation without causing each snap member to pivot inwardly.

This can be achieved by providing an electrical connector in which a supporting axle of each snap member is located between a sector-shaped bottom surface of the snap member and center of curvature of the sector so as to allow pivotal movement of the snap member about the supporting axle which travels along substantially vertically elongated holes provided in the side walls as the snap member is pivoted and/or a knurled edge and rib extended along the knurled edge are provided at the top end of the snap member for guiding the female connector toward the male connector pins so as to align the pin holes of the female connector with the male connector pins.

BRIEF DESCRIPTION OF THE DRAWINGS

A more complete understanding of the present invention may be obtained from the following description in conjunction with the attached drawings in which like reference numerals designate corresponding elements and in which:

FIGS. 7 through 12 show a first preferred embodiment of an electrical connector structure according to the present invention in which FIG. 7 is a perspective view of a male connector, FIG. 8 is a partially sectioned plan view of male and female connectors when they are about to be connected to each other, FIG. 9 is a perspective view of a snap member, FIG. 10 is a plan view in partial section of the male and female connectors when they are completely connected to each other, and FIGS. 11 and 12 are plan views in partial section of the male and female connectors as they are being separated from each other; and FIGS. 13, 14 and 15 show a second preferred embodiment of an electrical connector according to the present invention in which FIG. 13 is a perspective view of the male connector, and FIGS. 14 and 15 are plan views in partial section of the male and female connectors as they are being connected to each other.

DETAILED DESCRIPTION OF PREFERRED EMBODIMENTS

Reference will hereinafter be made to the drawings in order to facilitate understanding of the present invention.

FIGS. 7 through 12 show a first preferred embodiment of the present invention.

As shown in FIGS. 8 through 12, the base of each snap member 6 (6*l*, 6*r*) has a portion substantially in the form of a circular arc about a point F and the supporting axle 4*l*, 4*r* of each snap member 6*l*, 6*r* is guidably inserted into corresponding vertically elongated holes 25*l*, 25*r* penetrating both the front and rear walls of the male connector A, i.e., frame 16.

Figure 1:
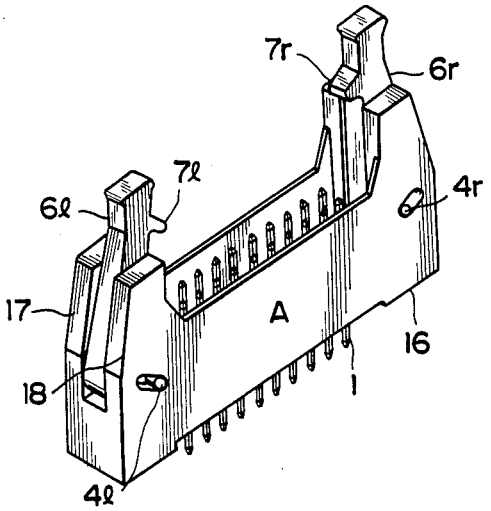
FIGS. 1 through 6 show an electrical connector structure disclosed in Japanese Utility Model Registration Ser. No. 58-51425.
Figure 2:
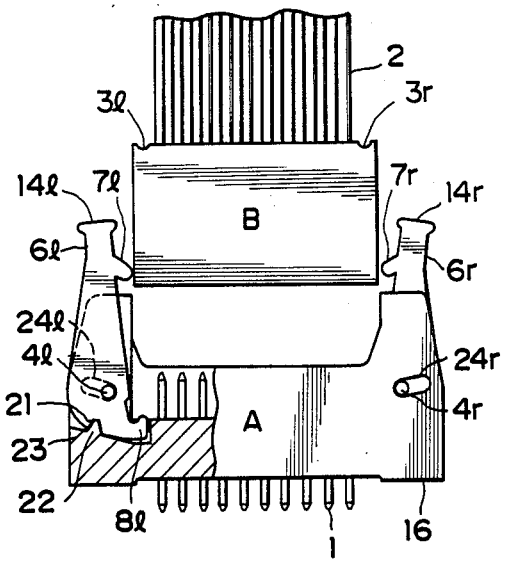
Figure 3:
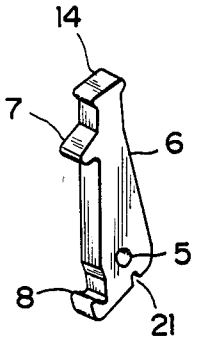
Figure 4:
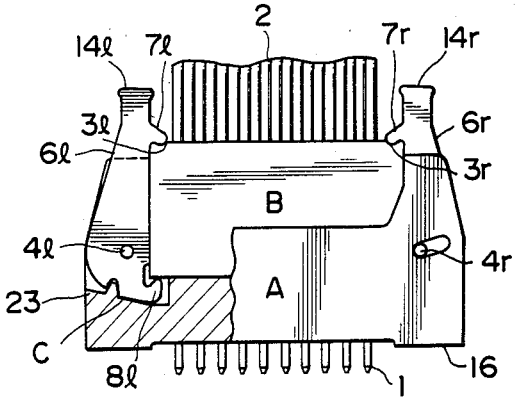
Figure 5:
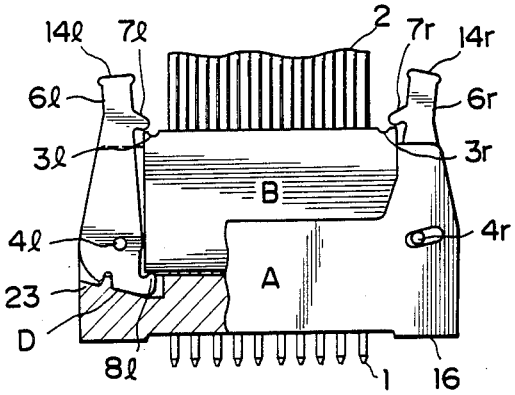
Figure 6:
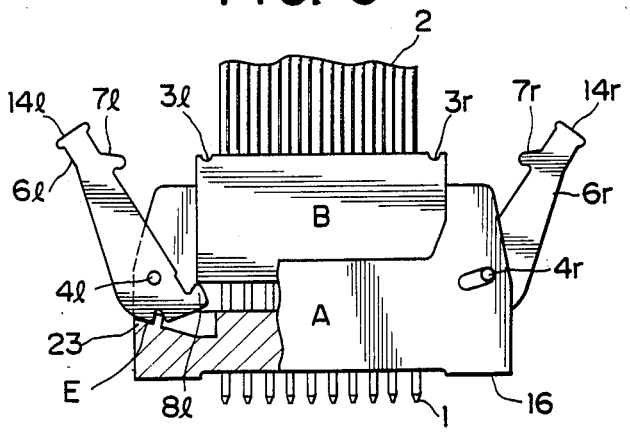
Figure 7:
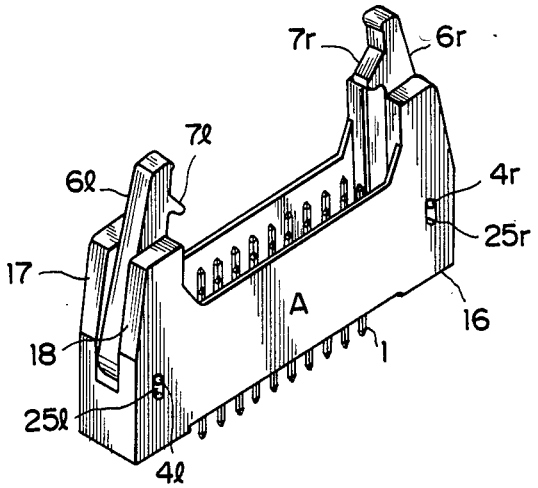
Figure 8:
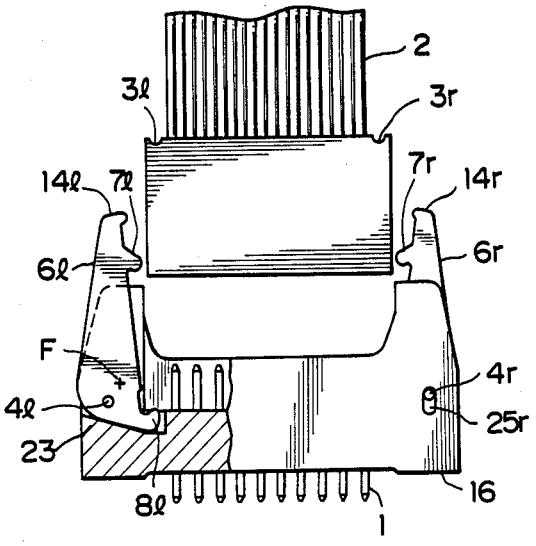
Figure 9:
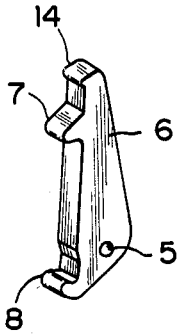
Figure 10:
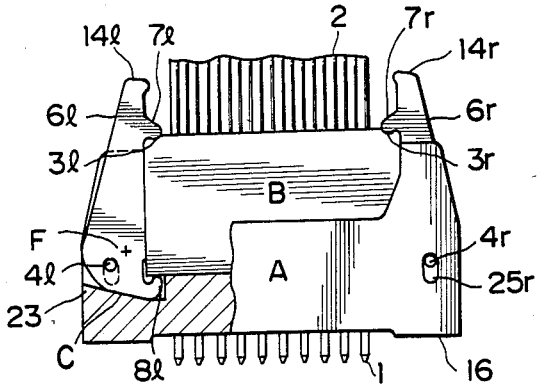

As shown in FIG. 10, when the female connector B is tightly secured to the male connector A, the bottom surfaces of the snap members 6 (6*l*, 6*r*) are in contact with the rolling surfaces 23 of the frame 16 at points C near the upwardly projecting fingers 8 (8*l*, 8*r*). In addition, each engagement pawl 7*l*, 7*r* is received by a corresponding recess 3*l*, 3*r* of the female connector B.

Figure 11:
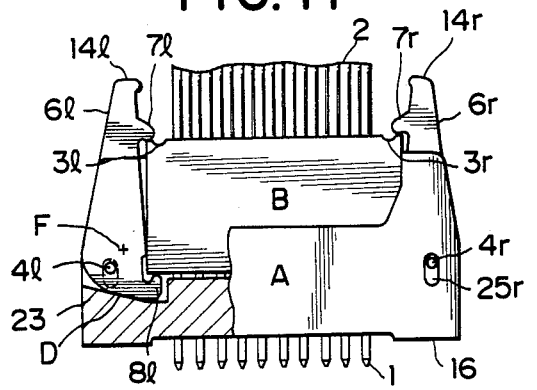
Figure 12:
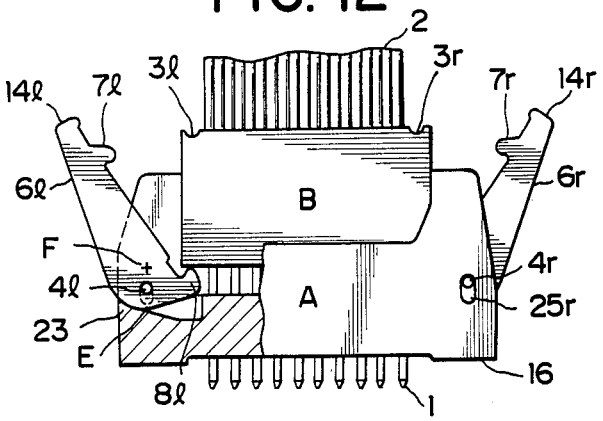

In addition, as shown in FIG. 11 as each snap member 6*l*, 6*r* is pivoted in its opening direction (outwardly), the above-described contact point shifts to point D and continues to point E when the snap members 6*l*, 6*r* reach their outward limit substantially as shown in FIG. 12.

It should be noted that although the corresponding supporting axle 4*l*, 4*r* tends to be translated outward with respect to the frame 16 as each snap member 6*l*, 6*r* is pivoted, the corresponding supporting axle 4*l*, 4*r* can move only in the vertical direction due to the limitation set by the corresponding vertically elongated hole 25*l*, 25*r*. The supporting axles 4*l*, 4*r* move downward as the snap members 6*l*, 6*r* are pivoted from the positions shown in FIG. 10 to that shown in FIG. 11 and then move upward as the snap members 6*l*, 6*r* are pivoted from the positions shown in FIG. 11 to the substantially final state shown in FIG. 12. To achieve this two-stage movement of each supporting axle 4*l*, 4*r*, the positions of the point E and supporting axles 4 and the stroke of the snap members 6*l*, 6*r* are selected.

The distance from the rolling contact point to the upwardly projecting finger 8*l*, 8*r* increases as the corresponding snap member 6*l*, 6*r* is pivoted toward the fully open (outward limit) position. However, the distance from the above-described contact points C, D, and E to the upper end 14 (14*l*, 14*r*) of the corresponding snap member 6*l*, 6*r* remains substantially unchanged. Therefore, at the beginning of the pivotal movement of each snap member 6*l*, 6*r* toward its fully open position, the leverage is so great that a light pivoting force on each snap member 6*l*, 6*r* permits the snap member 6*l*, 6*r* to remove the female connector B from the male connector A. The leverage decreases at the position at which the female connector pins (not shown) separate from the correspondingly fitted male connector pins 1 and as the snap members 6*l*, 6*r* are pivoted toward their fully open positions. Therefore, the amount of movement of the female connector B per unit of pivotal movement of each snap member 6*l*, 6*r* is accordingly increased. At this time, since the female connector pin holes do not substantially engage the corresponding male connector pins 1, only a light pivoting force on the snap members 6*l*, 6*r* is required.

In any case, the above-described pivotal movement of each snap member 6*l*, 6*r* is achieved with the base of each snap member being in sliding contact with the rolling surface 23 of the frame 16 since the corresponding supporting axle 4 is guided along the vertically elongated holes 25. Therefore, the total horizontal displacement of the snap members 6*l*, 6*r* is small even at the limit of vertical travel of the corresponding upwardly projecting finger 8. That is to say, there is no danger of the snap members 6*l*, 6*r* slipping off or separating from the bottom edge of the female connector B. On the other hand, since the supporting axle 4*l*, 4*r* of each snap member 6*l*, 6*r* can be set to stop at the upper end of the corresponding vertically elongated hole 25 when the female connector B is tightly fitted to the male connector A as shown in FIG. 10, the female connector B can be maintained at the tightly secured state with the aid of each engagement pawl 7 (7*l*, 7*r*).

In this embodiment, the leverage is increased to reduce the force required to pivot the snap members 6*l*, 6*r* from the beginning of their pivotal movement, which is relatively heavy and thereafter the leverage decreases as each snap member 6*l*, 6*r* approaches its fully open position, thus the stroke of the female connector B being increased without allowing the snap members 6*l*, 6*r* to project only minimally from the corresponding edge of the frame. This contributes to the space saving of the connector.

Figure 13:
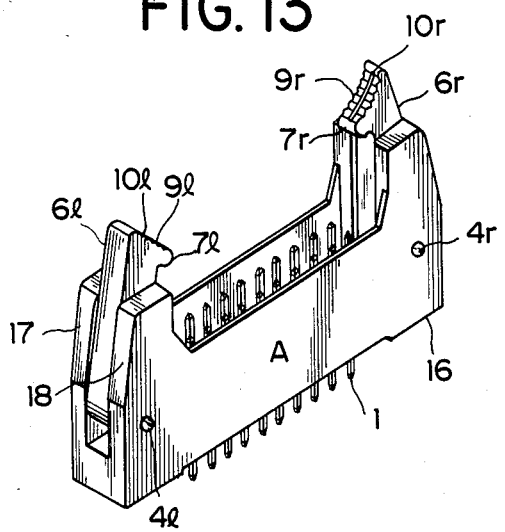
Figure 14:
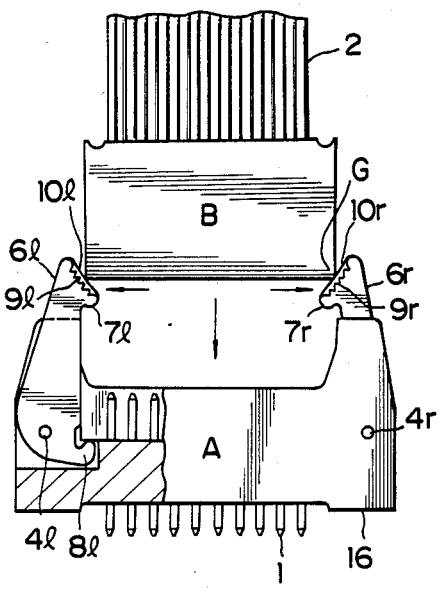
Figure 15:
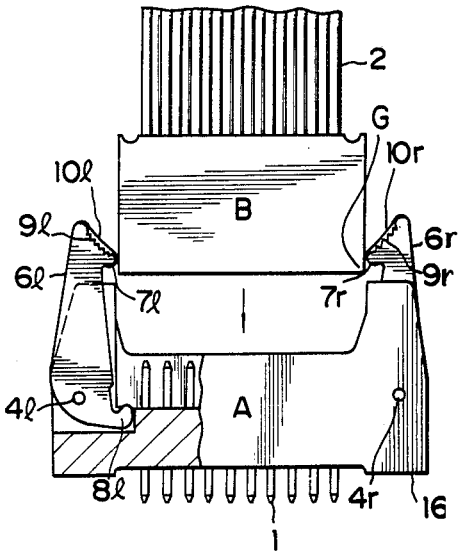

FIGS. 13 through 15 show a second preferred embodiment of the present invention.

As in the previous embodiment, the snap members 6*l*, 6*r* are axially supported so as to allow pivotal movement in opposite directions, and the female connector B is held in engagement with the male connector A when they are pivoted to their fully closed positions and is disengaged therefrom when they are pivoted to their open positions. In this embodiment, the snap members 6*l*, 6*r* also have knurled edges 9*l*, 9*r* along their top ends for preventing finger slippage when an operator pivots the snap member 6*l*, 6*r* with his finger and ribs 10*l*, 10*r* projecting substantially vertically from the corresponding knurled edge to allow the female connector B to slide smoothly toward the corresponding male connector.

As shown in FIG. 13, the knurled edges 9*l*, 9*r* are formed along the top end of each snap member 6*l*, 6*r* to prevent the operator's fingers from slipping when he or she pivots the snap members to release the connectors. The ribs 10*l*, 10*r* stand slightly higher than the top edges of the corresponding knurled edges 9*l*, 9*r* and are much narrower than the knurled edges 9*l*, 9*r*. In FIGS. 14 and 15, symbol G denotes a leading corner of the female connector B with respect to insertion in the corresponding male connector A and numerals 4*l*, 4*r* denote the supporting axle about which the corresponding snap member 6*l*, 6*r* pivots. The engagement pawl 7*l*, 7*r* projects from the inward end of the corresponding knurled end 9*l*, 9*r* and serves to secure the female connector B tightly to the male connector A after the corresponding snap member 6*l*, 6*r* is moved to its fully closed position.

When the operator tries to insert the female connector B into the male connector A with the snap members 6*l*, 6*r* in the closed position (normal rest position) as shown in FIG. 14, the leading corner G of the female connector B first contacts the corresponding rib 10*l*, 10*r* since the ribs 10*l*, 10*r* are slightly higher than the knurled edges 9*l*, 9*r*. If the female connector B is moved further toward the male connector A, the snap members 6*l*, 6*r* are forceably pivoted in the opening direction as the corner G of the female connector B slides along on the corresponding rib 10*l*, 10*r* smoothly. Thereafter, as shown in FIG. 15, the female connector B can be inserted into the male connector A without contact with the ribs 10*l*, 10*r*.

It should be noted that although in this embodiment, the ribs 10*l*, 10*r* are centered on the width of the knurled edges 9*l*, 9*r*, the same function can be achieved from any position on the knurled edges 10*l*, 10*r*. In addition, the width of the ribs 10*l*, 10*r* is arbitrarily selected.

In this way, the electrical connector of the second preferred embodiment allows the female connector B to be inserted into the male connector A simply by moving the female connector B toward the male connector A, even if the snap members 6*l*, 6*r* are in the closed position. That is to say, the female connector B can be inserted into the male connector A with a single operation.

Although in the first preferred embodiment shown in FIGS. 7 through 12, the top ends 14*l*, 14*r* of the left and right snap members 6*l*, 6*r* are not formed with the knurled edges 9*l*, 9*r* and ribs 10*l*, 10*r* as in the second preferred embodiment, the top end thereof may be formed with the knurled edges 9*l*, 9*r* and ribs 10*l*, 10*r*.

As described hereinbefore, the electrical connector can allow engagement of the female connector with the male connector and removal of the female connector from the male connector with a single operation.

It will clearly be understood by those skilled in the art that the foregoing description is in terms of preferred embodiments of the present invention and various changes and modification may be made without departing from the scope of the present invention which is to be defined by the appended claims.

What is claimed is:

1. A structure of an electrical connector for coupling male and female connectors, comprising;

(a) at least one connector pin of the male connector;

(b) a frame member having a base portion through which said connector pin of the male connector extends and having at least one pair of side walls extending from said base portion;

(c) at least one elongated snap member interposed between said pair of side walls for forcibly disengaging at least one connector pin receptacle of the female connector engaged with said connector pin of the male connector therefrom when an operator pivots said elongated snap member in a first direction so as to separate from said connector pin receptacle of the female connector and for locking said connector pin of the male connector in engagement with said connector pin receptacle of the female connector when the operator pivots in a second direction so as to approach to said connector pin receptacle of the female connector; and (d) at least one of the first means for producing a leverage action on a pivotal axis of said snap member to move in the direction of engagement and disengagement of said male and female connector pins with respect to said frame member when the operator pivots said snap member in the first and second directions so as to disengage and engage said connector pin receptacle of the female connector from and with said connector pin of the male connector, said first means including a base surface of said snap member in the shape of an arc and opposing a contact surface of said frame member, a finger projecting from the base surface in the direction to disengage said connector pin receptacle of the female connector from said connector pin of the male connector, a pivot pin projecting from said snap member toward both side walls of the frame member at a point between and spaced from both said base surface and a center of curvature of said base surface forming said arc, and means defining opposing holes penetrating said side walls for receiving said pivot pin of said snap member and elongated for allowing for movement of said pivot pin along said elongated opposing holes when the operator pivots said snap member in the first and second directions and second means formed on a surface of said snap member exposed to contact with said connector pin receptacle of the female connector and to engage a finger of the operator to outwardly pull said surface, said second means defining a predominantly rough finger engaging surface including a smooth projection which is located and shaped to prevent mutual contact which would otherwise take place between said rough surface and said connector pin receptacle of the female connector and which is inclined so as to guide said connector pin receptacle toward said connector pin of the male connector.

2. The electrical connector structure as set forth in claim 1, wherein said pivot pin of said snap member is located at the upper extremity of said elongated opposing holes when said female connector pin is engaged with said male connector pin, when said pivot pin moves downwardly away from said upper extremity, said projecting finger disengages said female connector pin receptacle from said male connector pin as said snap member is pivoted, and said pivot pin returns to said upper extremity at the time of the limit of pivotal movement of said snap member.

3. The electrical connector as set forth in claim 1, wherein said base surface of said snap member rollably and slidably contacts said contact surface of said frame member as said snap member pivots.

4. The electrical connector as set forth in claim 1, wherein the distance from said projecting finger to the point of contact between said base surface of said snap member and said contact surface of said frame member becomes greater as said snap member is pivoted on said supporting axle in the direction to drive the female connector out of engagement with said male connector.

5. The electrical connector as set forth in claim 1, wherein said second means comprises a knurled edge formed on said exposed surface of said snap member and a smooth rib extending along said knurled edge, the height of which is greater than that of said knurled edge so as to guide an edge of said female connector pin member toward said male connector member.

6. An electrical connector including a male connector having a plurality of pins and a horizontal elongated frame member through an intermediate portion of which said pins extend and from each end of which a pair of parallel side walls extend in a first direction perpendicular to the elongated frame and a female connector having a plurality of pin receptacles for receiving said pins of the male connector when the male and female connectors are engaged and a horizontally elongated frame member through which said pin receptacles are arranged, said electrical connector comprising means defining a pair of holes through said side walls, the holes being elongated in said first direction, a lever member interposed between said side walls and having a base surface shaped as a circular arc with a predetermined radius of curvature, said base surface of said lever member being in sliding and rolling contact with the end portion of said horizontally elongated frame member, a pivot pin disposed between said base surface and the center of the curvature thereof and extending through said pair of elongated holes so as to be guidably moved within said pair of elongated holes parallel to said first direction, in such a way that said pivot pin is moved first downwardly and then upwardly along the elongated holes as the lever member is pivoted to move the female connector upwardly and out of engagement with the male connector, and a finger projecting substantially in said first direction from said base surface into contact with said female connector when the male and female connectors are engaged, said finger driving said female connector out of engagement with said male connector when said lever is pivoted in one rotary direction.

7. The electrical connector as set forth in claim 6, wherein the end portions of said frame member of said male connector lie substantially obliquely to said intermediate portion thereof.

8. The electrical connector as set forth in claim 7, wherein said supporting axle of said lever member is located at one extreme of said pair of elongated holes when said male connector engages said female connector.

9. The electrical connector as set forth in claim 6, wherein said base surface of said lever member and said end portion of said frame member are so contoured that the distance from said finger to the point of contact between said arcuate base surface and said end portion increases as said lever member is pivoted to drive the female connector out of engagement with the male connector.

10. The electrical connector as set forth in claim 6, wherein an exposed edge of said lever member is provided with a knurled edge and a rib extending along and orthogonally to the knurls of said knurled edge.

* * * * *